United States Patent [19]

Abinett et al.

[11] Patent Number: 4,844,033

[45] Date of Patent: Jul. 4, 1989

[54] FUEL INJECTION PUMPING APPARATUS

[75] Inventors: Raymond E. Abinett, Strood; Peter A. G. Collingborn, Gillingham, both of England

[73] Assignee: Lucas Industries Public Limited Company, Birmingham, England

[21] Appl. No.: 151,825

[22] Filed: Feb. 3, 1988

[30] Foreign Application Priority Data

Feb. 13, 1987 [GB] United Kingdom ..... 8703418

[51] Int. Cl.[4] ..... F02M 39/00

[52] U.S. Cl. ..... 123/383; 123/450

[58] Field of Search ..... 123/383, 382, 387, 450, 123/386, 385, 504, 366; 417/462

[56] References Cited

U.S. PATENT DOCUMENTS

| | | | |
|---|---|---|---|
| 3,077,823 | 2/1963 | Parks | 123/383 |
| 3,726,263 | 4/1973 | Kemp | 123/383 |
| 3,742,925 | 7/1973 | Gordon | 123/383 |
| 4,149,507 | 4/1979 | Little | 123/383 |
| 4,154,204 | 5/1979 | Bonin | 123/382 |
| 4,380,223 | 4/1983 | Jefferson | 123/383 |
| 4,474,157 | 10/1984 | Skinner | 123/450 |
| 4,640,247 | 2/1987 | Bruning | 123/383 |

*Primary Examiner*—Carl Stuart Miller

*Attorney, Agent, or Firm*—Balogh, Osann, Kramer, Dvorak, Genova & Traub

[57] ABSTRACT

A fuel injection pumping apparatus for supplying fuel to a compression ignition engine has an annular cam ring which has internal cam lobes for imparting inward movement through cam followers respectively to pumping plungers mounted in a rotary distributor member. Stop rings are mounted alongside the cam ring to determine the maximum outward movement of the plungers. The stop rings are angularly adjustable to enable the maximum amount of fuel supplied to the engine to be varied. Two adjusting devices are provided the first being a piston which is subject to a fluid pressure varying with speed. The piston is biased by a spring and sets the stop rings to allow an excess of fuel for engine starting purposes and the second is a diaphragm assembly responsive to the air pressure in the engine inlet manifold. In order to save space the piston is slidable within a housing which also accommodates the diaphragm assembly and the diaphragm assembly is coupled to the stop rings by means of a push rod which passes through an aperture in the piston.

5 Claims, 2 Drawing Sheets

FUEL INJECTION PUMPING APPARATUS

This invention relates to a fuel injection pumping apparatus for supplying fuel to an internal combustion engine, the apparatus being of the kind comprising a rotary distributor member housed in a body, a transverse bore in the distributor member and a reciprocable plunger therein, a cam follower at the outer end of the plunger, an annular cam ring surrounding the distributor member and having inwardly directed cam lobes on its internal surface for engagement by the cam follower to impart inward movement to the plunger as the distributor member is rotated in synchronism with the associated engine, means for feeding fuel to the bore during at least part of the time the plunger is allowed to move outwardly by the cam lobes, passage means in the distributor member and body through which fuel displaced by said plunger during successive inward movements thereof is supplied to outlets in turn, a stop ring or rings mounted in the body, the stop ring or rings being engageable by the cam follower to limit the extent of outward movement of the plunger, the internal surface or surfaces of the stop ring or rings being shaped so that angular adjustment of the ring or rings will effect variation in the extent of outward movement of the plunger and thereby the maximum amount of fuel which can be supplied to the associated engine.

The ring or rings must be adjusted in use to allow an excess of fuel to be supplied to the associated engine for starting purposes and also in the case of a supercharged or turbo charged engine in accordance with the pressure of air in the inlet manifold of the engine. It is convenient to dispose the mechanisms which determine the excess fuel and the variation with air pressure in tangential relationship to the ring or rings since this simplifies the linkage connecting the mechanisms to the ring or rings. If separate mechanisms are used there occurs the problem of mounting the mechanisms on the body of the apparatus bearing in mind that the apparatus is secured to the structure of the associated engine in such a manner that one side of the apparatus lies in close proximity to the cylinder head or cylinder block of the engine. Any attempt to space the apparatus further from the engine will require redesign of the mounting for the apparatus and also the drive connection with the engine crankshaft. A further problem arises with the design of the apparatus since this already has a pressure operable timing piston which is located in tangential relationship to the cam ring.

The object of the invention is to provide such an apparatus in a simple and convenient form.

According to the invention an apparatus of the kind specified comprises a housing for attachment to the body, a piston slidable within a bore in the housing, the bore opening at one end to the interior of the body so that the piston is acted upon by fuel pressure within said body, valve means for ensuring that the fuel pressure increases within said body after starting of the associated engine, an abutment engageable by the end of the piston exposed to the pressure in the body, linkage means connecting said abutment with said stop plate or plates, first resilient means biasing said piston against the action of the fuel pressure and acting to urge the stop plate or plates in a direction to increase the amount of fuel which can be supplied to the associated engine, a rod slidable within a central aperture in the piston, one end of the rod being engageable with said abutment means, a diaphragm assembly mounted in the housing and including a spring loaded diaphragm upon which in use air under pressure in the air inlet manifold of the engine can act, the assembly including a member engageable with said rod to move the rod independently of the piston to adjust the setting of said stop plates.

By the arrangement outlined above the mechanisms for setting the stop plate or stop plates for the purpose of obtaining an excess of fuel for engine starting purposes and for adjusting the stop plate or plates in accordance with the air inlet manifold pressure are combined in a single housing which can be located on the body of the apparatus at any suitable position.

An example of an apparatus in accordance with the invention will now be described with reference to the accompanying drawings in which.

Figure 1:
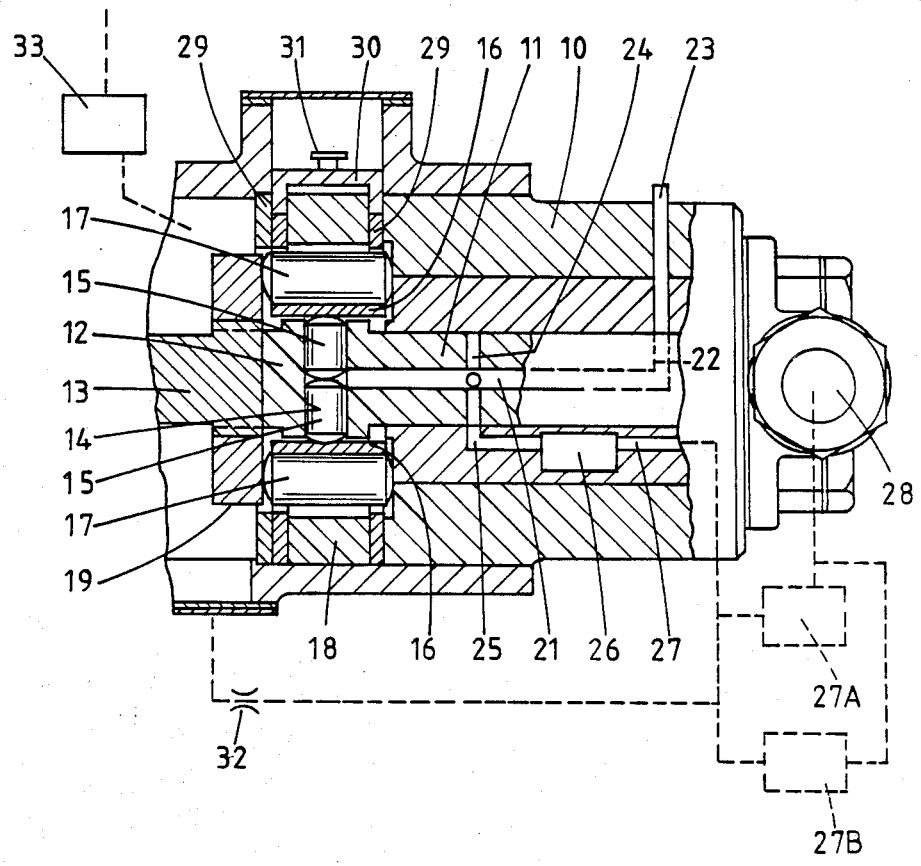
FIG. 1 is a sectional side elevation of the pumping apparatus.

Referring to FIG. 1 of the drawings the apparatus comprises a body 10 in which is located a sleeve which carries a rotary cylindrical distributor member 11. The distributor member is coupled to an input shaft 13 which extends from the body and which is adapted to be driven in timed relationship with an engine with which the apparatus is associated. Formed within an enlarged portion 12 of the distributor member is a transverse bore 14 in which is mounted a pair of reciprocable plungers 15 which are arranged to be moved inwardly as the distributor member rotates, through the intermediary of cam followers, by cam lobes formed on the internal peripheral surface of an annular cam ring 18 which is mounted for angular adjustment within the body. Each cam follower includes a shoe 16 and a roller 17 and the followers are located in slots respectively formed in a part 19 driven by the input shaft.

Also formed in the distributor member 11 is a longitudinally extending passage 21 which at one end is in communication with the bore 14 and at its other end is in communication with a radially disposed delivery passage 22. The delivery passage is arranged to register in turn with a plurality of equiangularly spaced outlet ports 23 which are in use connected by pipelines respectively to injection nozzles mounted on the associated engine. The aforesaid registration of the passage 22 with one of the outlet ports takes place during the whole time the plungers 15 are being moved inwardly so that liquid fuel contained in the bore 14 will be displaced to a combustion space of the engine.

At another point the longitudinal passage 21 is in communication with a plurality of equiangularly spaced and radially disposed inlet passages 24. The passages 24 are arranged to register in turn with an inlet port 25 which is formed in the body. In practice, in order to facilitate filling of the bore 14, two inlet ports 25 are provided these being angularly spaced by an amount equal to the angular spacing of the inlet passages 24.

The inlet ports 25 communicate with a throttle device 26 the setting of which is controlled by a speed responsive governor and the device communicates with the outlet 27 of a low pressure supply pump 27A having an inlet 28, the supply pump being located in the body 10. The supply pump incorporates a relief valve 27B so that its output pressure will vary in accordance with the speed at which the distributor member is driven. The arrangement is such that when the inlet passages 24 register with the inlet ports, fuel will flow from the outlet of the low pressure pump to the transverse bore 14 to effect outward movement of the plungers. The aforesaid registration takes place only during the time when the delivery passage 22 is out of register with an outlet port 23 and during the time when the rollers 17 are clear of the cam lobes. By adjusting the setting of the throttle device 26, the rate at which fuel can flow to the bore 14 can be controlled and hence also the amount of fuel delivered to the associated engine.

In order to control the maximum amount of fuel which can be supplied to the associated engine, a pair of stop plates 29 are positioned on the opposite sides of the cam ring 18. The stop plates 29 are interconnected by a bridge member 30 on which is mounted an actuating peg 31. The peg 31 is connected to adjusting mechanism as will be described with reference to FIG. 2, and the stop plates 29 define shaped stop surfaces having a radial dimension which increases in the direction of rotation of the distributor member. The stop surfaces act to limit the extent of outward movement of the plungers which can take place whilst the inlet passages 24 are in communication with the inlet ports 25. By varying the angular setting of the stop plates therefore the extent of outward movement of the plungers can be controlled.

A space within the body is supplied with fuel under pressure from the outlet 27 of the low pressure pump by way of a restrictor 32. The pressure of fuel within the space is controlled by a relief valve 33 which maintains a predetermined maximum pressure within the space by venting the fuel to a drain which may be the inlet of the low pressure pump. The flow of fuel into the space provides for lubrication of the working surfaces of the various parts within the space and it also assists in the removal of air which may be contained in the fuel.

Figure 2:
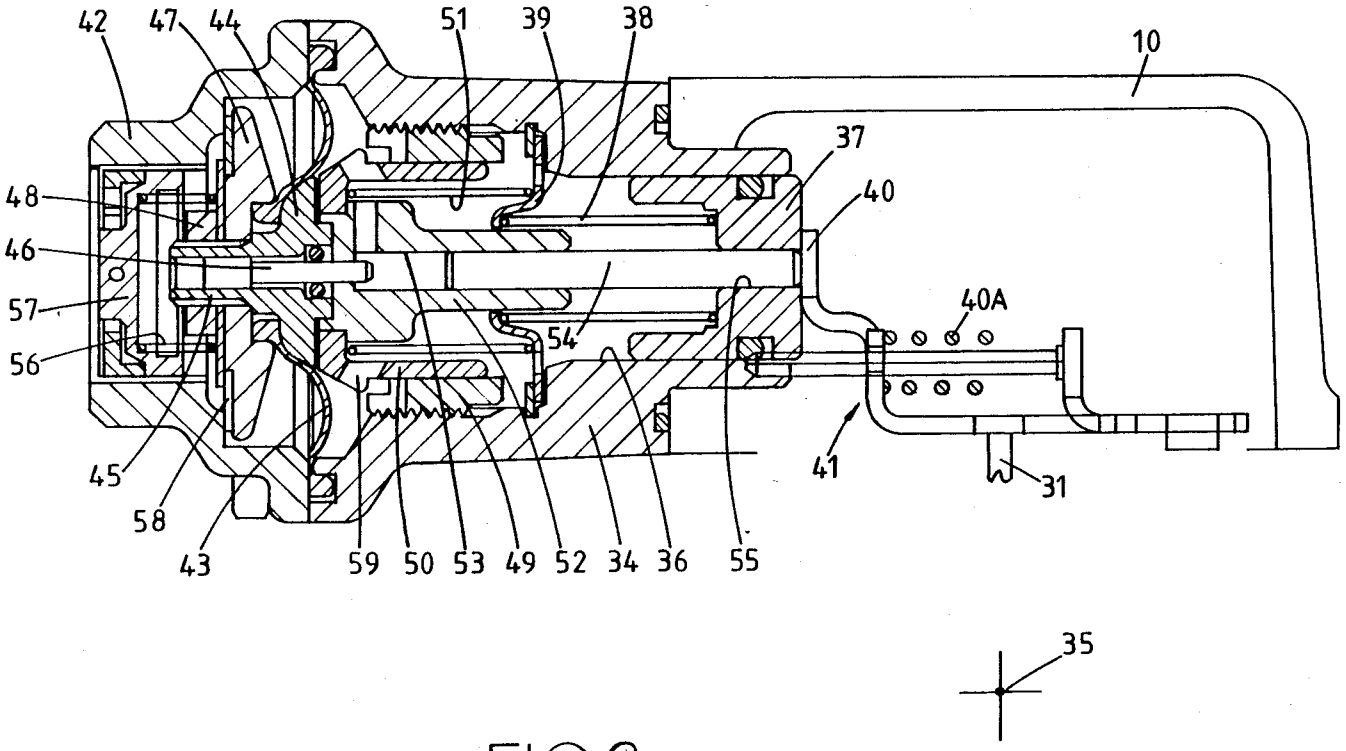
FIG. 2 is a section at right angles to FIG. 1 showing a further part of the apparatus not seen in FIG. 1.

Referring now to FIG. 2 of the drawings the apparatus includes a housing 34 which is secured to the body 10 to one side of the axis of rotation of the distributor member which is indicated in FIG. 2 at 35. The housing 34 defines a stepped internal surface the narrower portion of which constitutes a bore 36 which communicates with the space in the body. Slidable within the bore 36 is a piston 37 and this is biased in a direction into the space within the body, by means of a coiled compression spring 38. The opposite end of the compression spring is engaged with an abutment plate 39 which is secured against a step defiined by the internal surface of the housing.

The piston 37 is engageable with an abutment 40 and this is coupled by means of a linkage generally indicated at 41, with the peg 31. The linkage is lightly biased by a spring 40A so that the abutment 40 is urged into contact with the piston 37.

The end of the housing remote from the body 10 is closed by a closure member 42 and sandwiched between the closure member 42 and the housing 34 is the outer periphery of a diaphragm 43 which forms part of a diaphragm assembly. Included in the diaphragm assembly is a mushroom-shaped member 44 defining an externally screw threaded shank 45 which is also provided with an internal thread which is engaged by a push member 46. The inner peripheral surface of the diaphram is held against the underside of the head of the member 44 by means of an annular plate member 47 which is in screw thread engagement with the shank and which is locked in position by means of a locking nut 48.

The intermediate portion of the interior surface of the housing is provided with a screw thread which serves to mount an annular stop member 49 and slidable within this member is the skirt portion of an annular member 50 which defines an inwardly extending flange which is urged into engagement with the head of the mushroom-shaped member 44 by means of a coiled compression spring 51, the spring 51 at its end remote from the flange engaging with the abutment plate 39. Also forming part of the diaphragm assembly is a guide member 52 which is slidable through a central aperture in the abutment plate 39 and which defines a central bore 53 in which is slidably mounted a push rod 54. The push rod extends through a central aperture 55 in the piston 37 so that it can engage with the abutment 40. The space between the diaphragm 43 and the piston is vented to a drain such as the inlet of the pump 27A and the space defined between the closure member 42 and the diaphragm is connected to the inlet manifold of the associated engine which is of the turbocharged variety. An additional spring 56 is mounted between the diaphragm assembly and an adjustable closure 57, which is adjustably mounted on the closure member 42. The spring 56 acts in opposition to the spring 51 but is of lesser strength and is provided for the purpose of adjusting the effective spring force acting on the diaphragm assembly.

In operation, and assuming for the moment that the connection to the inlet manifold is disconnected. With the engine at rest the piston 37 is urged by its spring 38 to the position shown in FIG. 2 and in so doing it urges the abutment 40, the linkage 41 and the peg 31 to a position in which the stop rings permit an excess amount of fuel to be supplied to the associated engine for starting purposes.

When the associated engine has started the fuel pressure within the space in the body 10 starts to increase and when the pressure on the piston balances the force exerted by the spring 38, the piston will move towards the left as seen in FIG. 2 and by virtue of the light spring 40A which loads the linkage, the stop plates will move to reduce the maximum amount of fuel which can be supplied to the engine. The normal maximum amount of fuel is determined when the push rod 54 engages the push member 46. Since the push member 46 is adjustably mounted in the mushroom-shaped member 44, the maximum amount of fuel can be preset, this maximum corresponding to low load operation of the engine when the turbocharger is ineffective.

Assuming now that the connection to the inlet manifold is in place and the load on the engine is increased. As the turbocharger begins to pressurize the air in the air inlet manifold, the diaphragm assembly will start to move towards the right as seen in FIG. 2 against the action of the spring 51 and the rod 54 will be urged by the push member 46 towards the right thereby moving the abutment 40 in the direction to increase the maximum amount of fuel which can be supplied to the associated engine. The extent of movement of the diaphragm assembly and hence the extent by which the maximum amount of fuel can be increased, is determined by the abutment of an annular projection 59 on the external surface of the skirt portion of the push member 50, with the annular stop member 49.

It is convenient to temporarily prevent movement of the diaphragm assembly whilst the pressure in the inlet manifold builds up and this is achieved by shielding the diaphragm 43 from the actual air inlet manifold pressure using the annular plate member 47 which as will be seen in FIG. 2, mounts a seal member 58 which is engageable with a step defined on the closure member 42. The effective area of the member 47 is less than that of the diaphragm so that a differential action is obtained.

It will be noted that the housing 34 together with the closure member 42 which accommodate the piston and the diaphragm assembly are located on one side of the main body 10 and this facilitates the mounting of the pumping apparatus on the associated engine.

We claim:

1. A fuel injection pumping apparatus for supplying fuel to an internal combustion engine, comprising a rotary distributor member housed in a body, a transverse bore in said distributor member and a reciprocable plunger therein a cam follower at the outer end of said plunger, an annular cam ring surrounding said distributor member and having inwardly directed cam lobes on its internal surface for engagement by said cam follower to impart inward movement to said plunger as said distributor member is rotated in synchronism with said associated engine, means for feeding fuel to said bore during at least part of the time said plunger is allowed to move outwardly by said cam lobes, passage means in said distributor member and body through which fuel displaced by said plunger during successive inward movements thereof is supplied to outlets in turn, a stop ring or rings mounted in said body, said stop ring or rings being engageable by said cam follower to limit the extent of outward movement of said plunger, internal surface or surfaces of said stop ring or rings being shaped so that angular adjustment of said ring or rings will effect variation in the extent of outward movement of said plunger and thereby the maximum amount of fuel which can be supplied to said associated engine, characterised by a housing for attachment to said body, a piston slidable within a bore in said housing, said bore opening at one end to the interior of said body so that said piston is acted upon by fuel pressure within said body, means for ensuring that the fuel pressure increases within said body after starting of said associated engine, an abutment engageable by an end of said piston exposed to the pressure in said body, linkage means connecting said abutment with said stop plate or plates, first resilient means biasing said piston against the action of the fuel pressure and acting to urge said stop plate or plates in a direction to increase the amount of fuel which can be supplied to said associated engine, a rod slidable within a central aperture in said piston, one end of said rod being engageable with said abutment, a diaphragm assembly mounted in said housing and including a spring loaded diaphragm upon which in use air under pressure in an air inlet manifold of said engine can act, said assembly including a member engageable with said rod to move said rod independently of said piston to adjust the setting of said stop plates.

2. An apparatus according to claim 1 characterised by a space defined in said housing intermediate said piston and said diaphragm, said space communicating with a drain.

3. An apparatus according to claim 1 characterised in that said diaphragm assembly includes an annular member connected to said diaphragm, said annular member mounting a seal member for engagement in the rest condition of the engine, against a step defined by said housing whereby the initial area of said diaphragm assembly presented to the air pressure within said inlet manifold of the engine is less than the area of said diaphragm.

4. An apparatus according to claim 1 characterised in that said diaphragm assembly includes a guide member defining a bore in which said push rod can slide, and push member adjustably mounted in said bore, said push member after a predetermined movement of said diaphragm assembly under the action of the air pressure engaging said push rod to effect movement of said stop ring or rings.

5. An apparatus according to claim 4 characterised in that said diaphragm assembly includes a further member defining a skirt, said skirt being slidable within an annular stop member adjustably mounted in said housing, said skirt member defining a projection for engagement with said stop member to limit the extent of movement of said diaphragm assembly under the action of the air pressure.

* * * * *